United States Patent [19]

Knaus

[11] Patent Number: 4,573,508

[45] Date of Patent: Mar. 4, 1986

[54] COLLAPSIBLE STORAGE TANK

[75] Inventor: Ernest Knaus, Akron, Ohio

[73] Assignee: Goodyear Aerospace Corporation, Akron, Ohio

[21] Appl. No.: 719,842

[22] Filed: Apr. 4, 1985

[51] Int. Cl.[4] ..... B65D 88/16; B65D 90/02; B65D 90/08

[52] U.S. Cl. ..... 150/55; 220/1 B; 220/453; 383/908

[58] Field of Search ..... 150/55; 220/1 B, 85 B, 220/414, 453; 222/94, 567, 573; 244/135 B; 383/107, 109, 904, 906, 908; 206/521

[56] References Cited

U.S. PATENT DOCUMENTS

| | | | |
|---|---|---|---|
| 2,615,487 | 10/1952 | Cunningham | 150/55 |
| 2,724,418 | 11/1955 | Krupp | 150/55 |
| 2,865,419 | 12/1958 | Cunningham | 383/908 X |
| 2,884,978 | 5/1959 | Grimm | 150/55 |
| 2,930,423 | 3/1960 | Cunningham et al. | 222/94 |
| 3,400,741 | 9/1968 | Robinson et al. | 150/55 |
| 3,559,708 | 2/1971 | Cook | 206/521 |
| 3,779,420 | 12/1973 | Knaus | 383/107 X |
| 3,978,901 | 9/1976 | Jones | 150/55 |

FOREIGN PATENT DOCUMENTS

| | | | |
|---|---|---|---|
| 1203031 | 7/1959 | France | 150/55 |
| 1313573 | 11/1962 | France | 222/94 |
| 1460825 | 12/1966 | France | 150/55 |
| 979449 | 1/1965 | United Kingdom | 150/55 |

*Primary Examiner*—William Price
*Assistant Examiner*—Sue A. Weaver
*Attorney, Agent, or Firm*—P. E. Milliken; L. A. Germain

[57] ABSTRACT

A flexible and collapsible storage tank (10) for holding large volumes of material is fabricated in a rectangular shape from long lengths of a rubberized square-woven fabric. The lengths of fabric are oriented with overlapping adjacent edges to form inner (122) and outer (124) envelope structures which are integrally vulcanized into a homogeneous tank body (20). The inner envelope (122) is formed by longitudinally oriented fabric plies (22) having overlapping adjacent edges (22*a*) while the outer envelope (124) is formed by edge plies of fabric (26) folded about the peripheral edges of the inner envelope (122) and orthogonally oriented fabric plies (24) positioned on either side of the inner envelope (122). The tank (10) includes an air vent valve (40) mounted in its top and a closure (30) which clamps and seals a corner exposure (20*a*) of the tank body (20) and provides access and communication into the tank for filling and emptying.

8 Claims, 13 Drawing Figures

FIG.-3
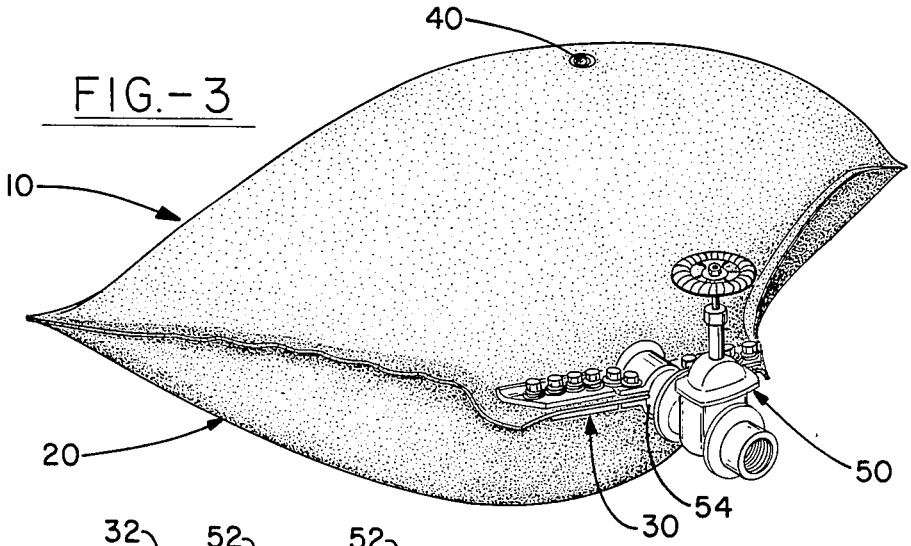
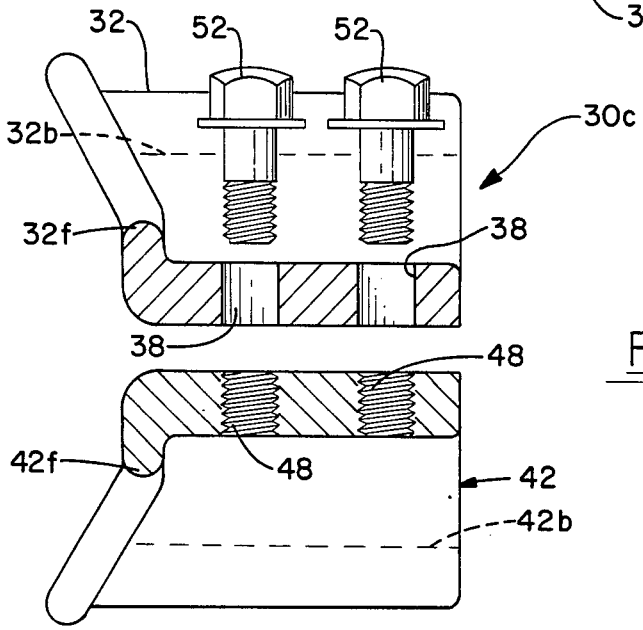
FIG.-6
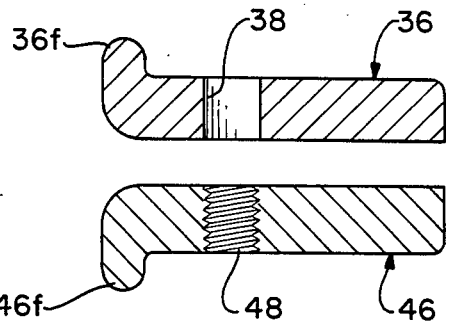
FIG.-7

COLLAPSIBLE STORAGE TANK

BACKGROUND OF THE INVENTION

This invention generally relates to collapsible tanks and more particularly to a large storage tank of the type comprised of a rubberized fabric material which when filled may be transported via large truck or rail carrier to a remote location and when emptied may be rolled and/or folded into a compact size for return and refilling.

The invention provides a simplified and improved construction for a large volume, collapsible storage tank wherein a square-woven fabric is impregnated with a suitable elastomer and wide widths and long lengths of the rubberized fabric are utilized in the fabrication of a double envelope configuration for the tank body. The double envelope type construction and the resultant orientation of the fabric yarns provides a flexible tank structure capable of holding very large volumes of liquid and/or other type of materials and allows the application of an improved and lighter weight closure means while providing adequate access into the tank body by personnel for cleaning and servicing of the tank.

SUMMARY OF THE INVENTION

This invention provides a collapsible storage tank for holding large volumes of material, which tank comprises a substantially rectangular tank body comprised of integrally vulcanized inner and outer envelope structures of rubberized square-woven fabric, the inner envelope structure formed by a plurality of long lengths of the fabric having overlapping adjacent edges and oriented longitudinally while the outer envelope structure is formed by a plurality of edge plies of fabric folded about the peripheral edges of the inner envelope structure and a plurality of lengths of fabric having overlapping adjacent edges and oriented orthogonally on either side of the inner envelope; a vent valve mounted in the top of the tank body to communicate air into and out of the interior, and a closure means mounted at one end and across a corner exposure of the tank body to seal the corner exposure and provide a connection for communication into the tank body.

BRIEF DESCRIPTION OF THE DRAWINGS

The details of the invention and various advantages thereof will be better understood from a consideration of the following detailed description and the accompanying drawings, in the several figures in which like reference numerals indicate like elements and wherein:

FIG. 3 is a perspective view, similar to FIG. 2, showing the tank as it may be inflated and/or filled to its volume capacity;

FIG. 6 is an elevational view, in cross-section, of the closure means as may be taken on line 6—6 of FIG. 4;

FIG. 7 is an elevational view, in cross-section, of the closure means as may be taken on line 7—7 of FIG. 4;

DETAILED DESCRIPTION OF THE INVENTION

Figure 1:
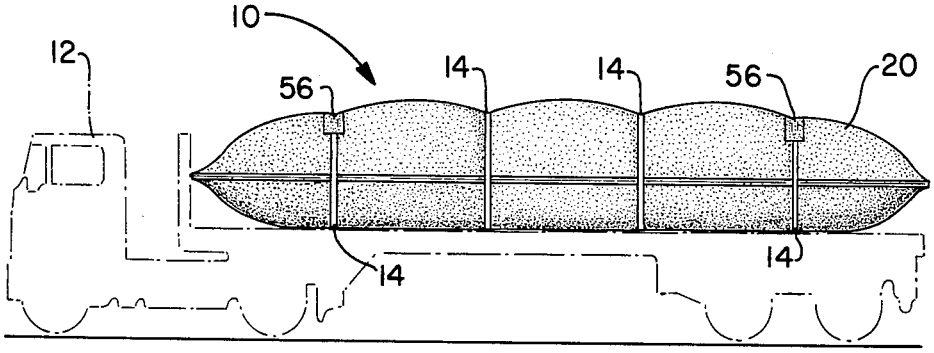
FIG. 1 is an elevational view of a collapsible storage tank in accordance with this invention showing the tank as it may be carried by a tractor-trailer type vehicle, the vehicle being illustrated in ghost by the dot-dashed lines.
Figure 2:
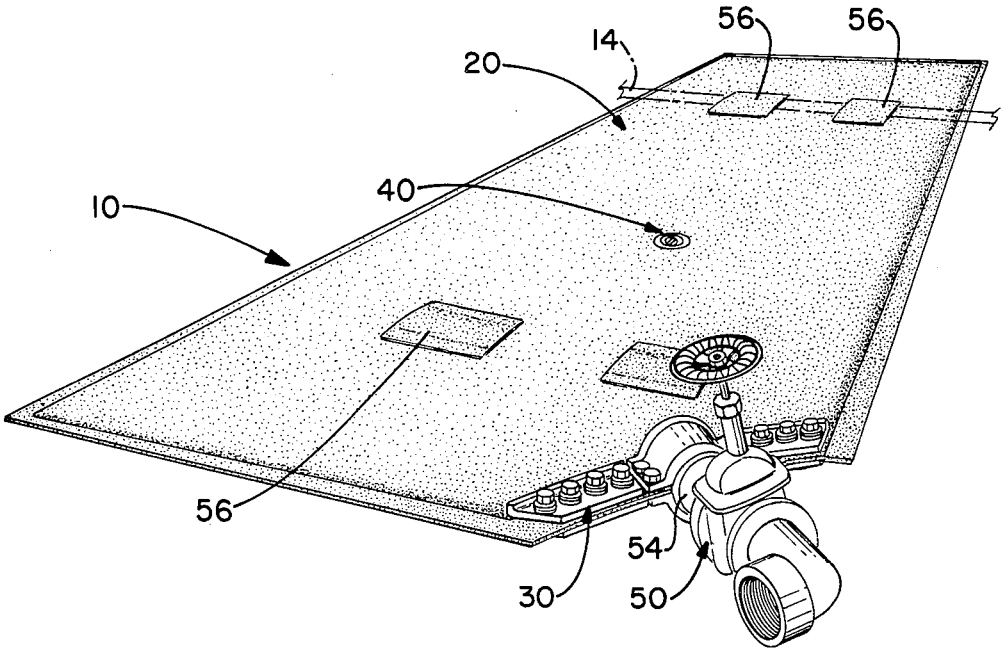
FIG. 2 is a perspective view showing the tank in a collapsed and flattened condition.
Figure 4:
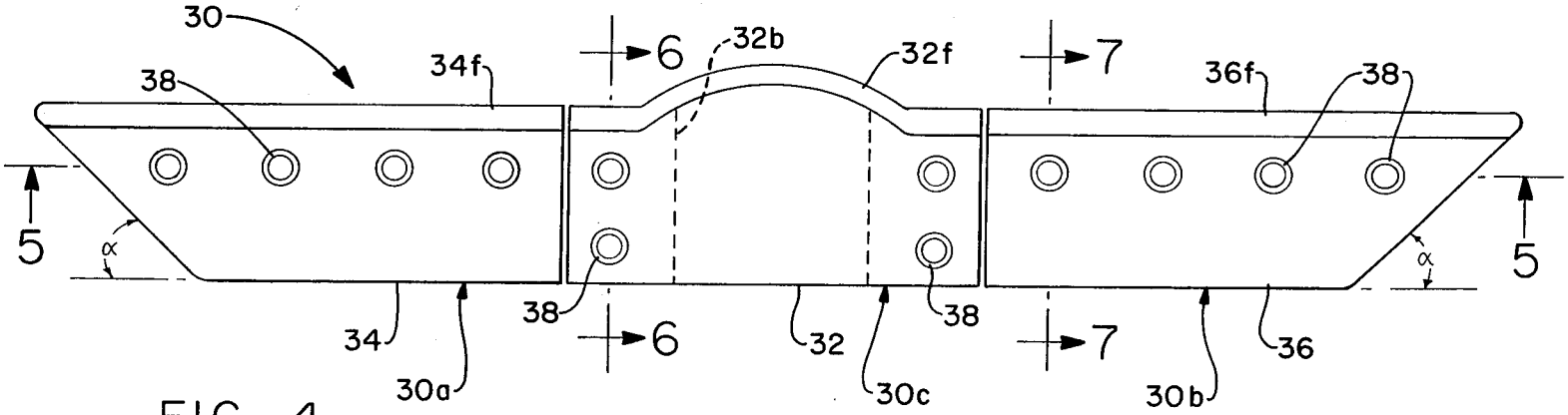
FIG. 4 is a top plan view of the end closure means used for accessing the interior of the tank and for attaching valve means as may be used for filling and emptying the tank.
Figure 5:
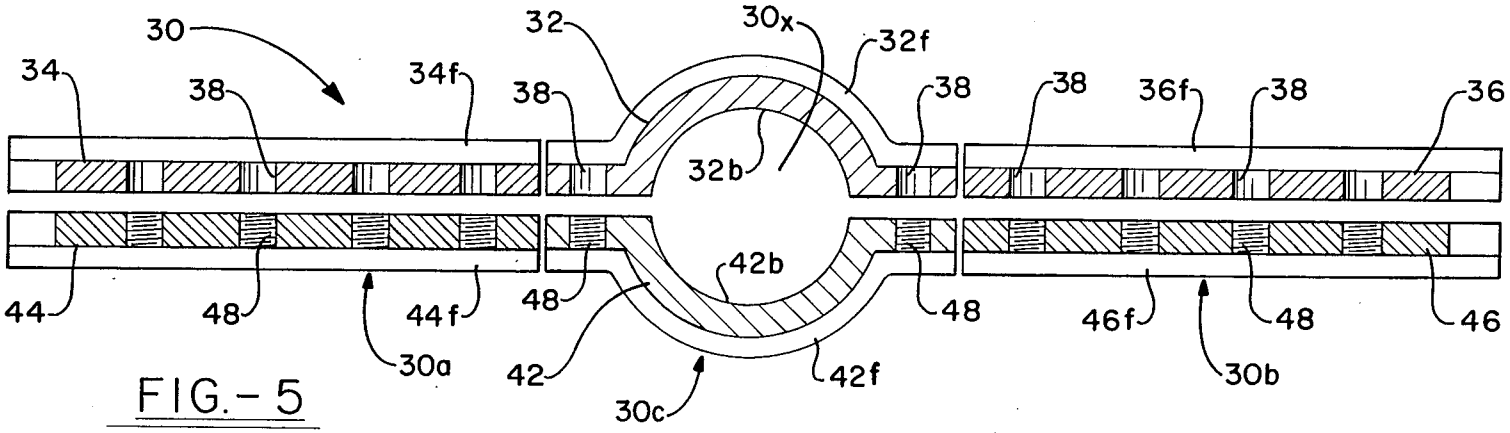
FIG. 5 is an elevational view, in cross-section, of the closure means as may be taken on line 5—5 of FIG. 4.

Referring firstly to FIGS. 1, 2, and 3 of the drawings, a collapsible storage tank is illustrated and generally indicated by reference numeral 10. The tank 10 is shown in FIG. 1 as it may be carried and transported in a filled condition by a large tractor-trailer vehicle 12, the relative size of the tank 10 with reference to the vehicle 12 being clearly evident in the drawing. The tank 10 is strapped down to the flatbed of the trailer by a plurality of tie-down straps indicated at 14, and this, in a conventional and well-known manner.

Generally, the tank 10 comprises a rubberized fabric body 20, an end closure 30 for accessing the interior of the body 20, and vent means 40 positioned at the approximate top of the tank to exhaust air when filling and emptying the tank. A valve generally indicated at 50 may be affixed to the closure means 30 for use in the filling and emptying operations of the tank in the usual manner.

The tank body 20 is an integrally vulcanized homogeneous structure comprising a square-woven, elastomer-impregnated, fabric and preferably comprises monofilaments or multifilament yarns of synthetic or natural fibers and nylon, polyester, or aramid fibers are the preferred materials for this application. As stated hereinbefore, the fabric is square-woven i.e., comprises warp and weft yarns, and this is accomplished by conventional weaving techniques. The width of the woven fabric is preferably the widest available by such weaving techniques and the reason for this will become apparent as the description proceeds. The length of the woven fabric may be made to any length or may be endless and rolled for later use. In this way, specific lengths may be cut from the roll in accordance with the desired tank length to be fabricated.

Figure 8:
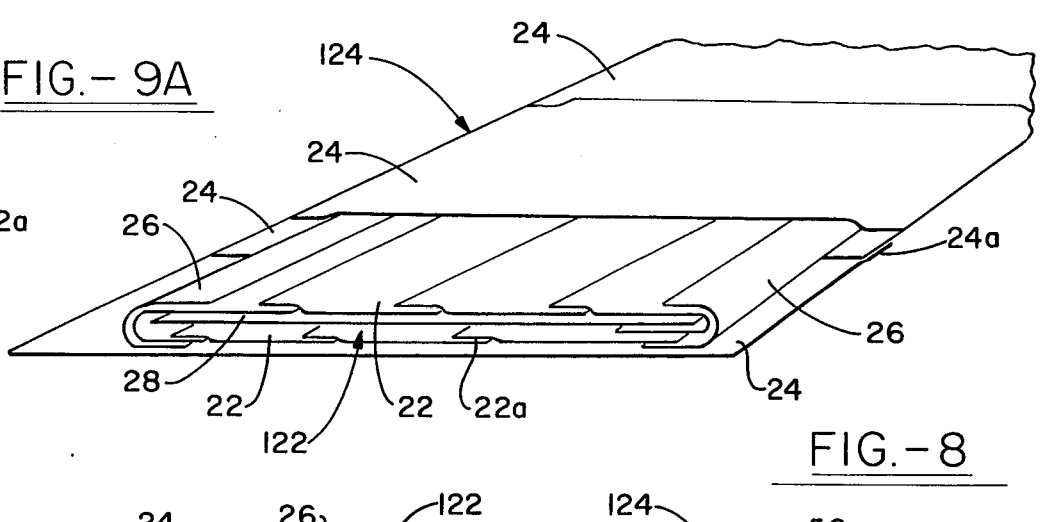
FIG. 8 is a perspective view diagrammatically illustrating the various ply orientations which comprise the tank body.

Referring now to FIG. 8 of the drawings, a tank body 20 is shown diagrammatically and comprises:

(a) a plurality of longitudinally oriented plies 22 of rubberized fabric, the plies being of a specific length and the longitudinal edges **22*a* being overlapped to form an inner envelope structure generally indicated by reference numeral 122**;

(b) a plurality of orthogonally oriented plies 24 of the same rubberized fabric as the plies 22, the longitudinal edges **24*a* being overlapped and the plies 24 being positioned transversely of the plies 22 to form an outer envelope structure generally indicated by reference numeral 124; and (c) a plurality of edge plies of rubberized fabric 26 positioned between the longitudinally oriented plies 22 and orthogonally oriented plies 24 about the periphery of the inner envelope 122 to provide strengthening at the edges of the tank and to aid in tying the top and bottom orthogonal plies 24 together. The ply of material indicated at 28 comprises a release type material which is used in the fabrication of the tank body 20 to keep the plies 22 of the envelope 122 from being vulcanized into an inseparable mass. The ply 28** is removed from the interior of the finished tank body upon completion of the vulcanization.

Referring now to FIGS. 9A–9E, the tank body 20 is fabricated by first laying out the longitudinal plies 22 on a flat surface and overlapping adjacent edges as indicated at 22*a*. Preferably, the center plies of the group are longer than the side plies by a specific amount and these cover the intended width of the finished tank body 20. Thus, end tabs 22*b* are evident in the laid-out configuration of the longitudinal plies 22 shown in FIG. 9A.

Figure 9E:
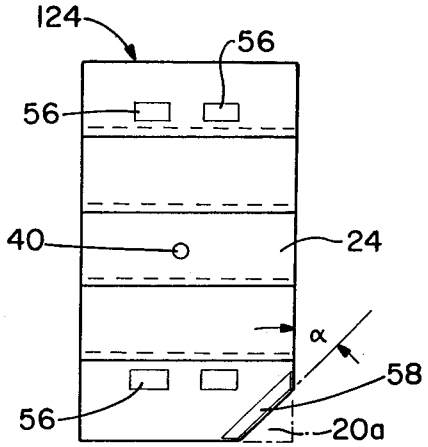
FIGS. 9A–9E diagrammatically illustrate the sequence of steps in fabricating the tank body.
Figure 9D:
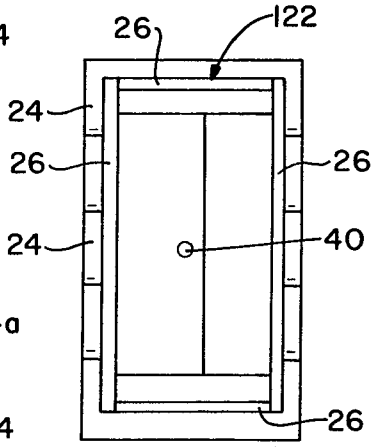

Next a ply of a release type material indicated at 28 is positioned centrally within the confines of the laid-out longitudinal plies 22 and the shorter of the plies on either side are folded over toward the center as indicated by the arrows and overlapped to form a tubular-like enclosure. The end tabs 22*b* are also folded toward the center to complete an inner envelope structure 122 as shown in FIG. 9B of the drawing.

Figure 9C:
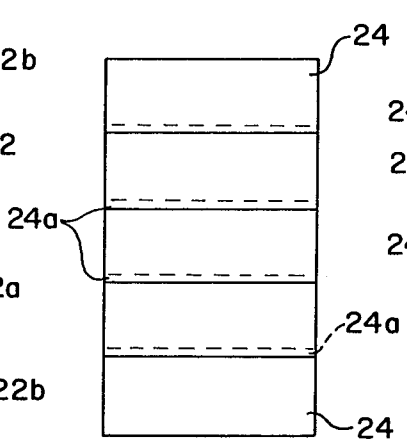
Figure 9A:
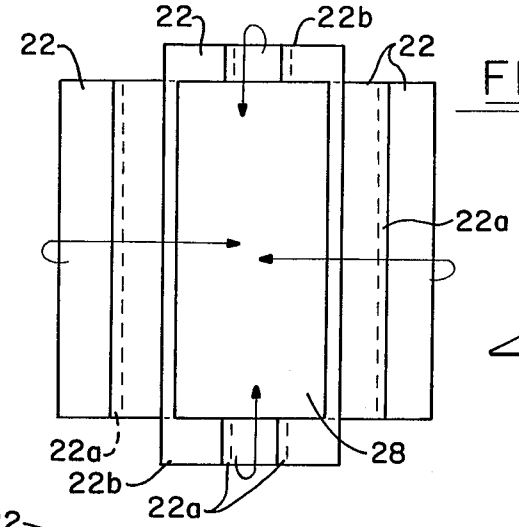
Figure 9B:
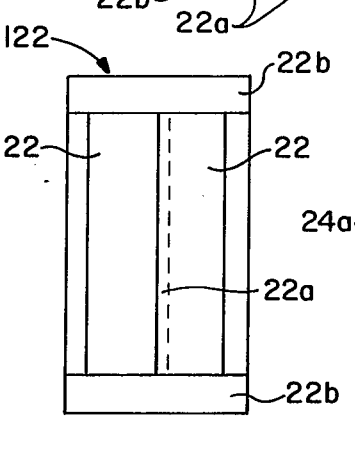

To continue, a plurality of plies 24 of the same type rubberized fabric are laid out as illustrated in FIG. 9C and these have their longitudinal edges 24*a* overlapped, the lengths of the plies 24 being slightly longer than the design width of the finished tank for reasons to become apparent hereinafter. The inner envelope structure 122 is laid out over the plies 24 and transversely to the direction of the plies 24 as shown in FIG. 9D and a top vent means 40 is mountd in the material at the approximate center of the envelope 122. A plurality of edge plies 26 are positioned about the periphery of the inner envelope structure 122 in the manner illustrated in FIG. 8 of the drawing and a second plurality of plies 24 are laid out over the assembly as shown in FIG. 9E. An outer envelope structure generally indicated at 124 is therefore formed by the two lays of orthogonal plies 24 and edge plies 26 which tie the top and bottom orthogonal plies 24 together.

The fabricated tank body 20 shown in FIG. 9E is vulcanized in a vacuum blanket and a pressure autoclave of the type known and used by persons working in the art, and such vulcanization unites all of the plies 22,24 and 26 into a homogeneous and integral wall structure. Upon completion of the vulcanization, the edges formed by the orthogonal plies 24 may be trimmed about the periphery of the tank body and a corner cut off as indicated at 20*a* in FIG. 9E so as to expose the interior of the tank. Of course, the corner exposure may be accomplished during the fabrication steps shown in FIGS. 9A–9D. For example, at each step of the procedure various of the ply materials may be cut off to maintain the corner exposure throughout the fabrication process. Also, and because of the overlapping arrangement of the various plies, it is important that the ply materials at corner exposure present a substantially uniform cross-section. Accordingly, FIG. 9E shows a shim of rubberized fabric at 58. While fabric 58 is also square woven, the orientation of the yarns is preferably at the angle $\alpha$ with respect to the tank axis. The advantage of this will become clear as the description proceeds with respect to the closure means 30 which is installed to seal the corner exposure 20*a* of the tank and provide a connection to a valve 50 for filling and emptying of the tank.

Referring now to FIGS. 4–7 of the drawings, the closure means 30 is illustrated in various views to show the elements thereof. The closure means 30 comprises a center portion 30*c* which is flanked by side portions 30*a* and 30*b* and this multi-piece configuration provides an assembly that is easily installed on the tank body 20, is lighter weight overall because of the limited number of parts, and gives the closure means an amount of flexibility which a one-piece ridged unit would not have.

The center portion 30*c* comprises a top member 32 and a bottom member 42, the two members combining in their assembled relationship to define a bore 30*x* into the interior of the tank by reason of semi-circular arcs 32*b* and 42*b* respectively. The bore 30*x* is, of course, adapted for receiving a pipe stud or hose shank end 54 of a suitable valve means 50 in a locking relationship and the rubberized fabric material of the tank body provides the necessary seal therebetween. The top and bottom members 32,42 are also characterized by smooth flanges 32*f*, and 42*f* and a plurality of aligned bolt holes or bores 38 and 48 respectively. While the holes 38 in the top member 32 may be smooth bores, the holes 48 are threaded for receiving bolts 52 therein. When the threaded engagement is made, the bottom member 42 is drawn up to the top member 32 to effect a sealing relationship when the material of the tank body 20 is positioned between the two members. The smooth flanges 32*f* and 42*f* are positioned toward the tank body 20 so that when the tank is filled, a smooth transition surface is adjacent the rubberized fabric material.

The side portions 30*a* and 30*b* of the closure means 30 are mirror images of each other and these comprise top members 34 and 36 respectively which are in registration with bottom members 44 and 46. Again, the side members 30*a*,30*b* have a plurality of bolt receiving bores 38,48 such that when bolts 52 are inserted the two members are drawn together to effect a sealing relationship when the rubberized fabric is positioned between them. The side portions 30*a*,30*b* are also characterized by smooth flanges 34*f*,36*f* on the top members 34,36 and flanges 44*f*,46*f* on the bottom members 44,46 respectively. The side portions 30*a*,30*b* also have ends which are cut to an angle $\alpha$ of approximately 45 degrees so as to meet the edges of the rectangularly shaped tank body 20 and to eliminate any hangover of the closure means beyond the material comprising the tank. It will be appreciated that, because of the orientation of the closure means 30 across a corner of the rectangularly shaped tank body 20 and because of the orientation of the yarns of the square-woven fabric, the individual bolts 52 are each entrapped by different rows of yarns within the fabric material. This arrangement insures clamping of a sufficient number of crossed yarns eliminating pull-out of the fabric and therefore a stronger closure arrangement is provided than could be accomplished when the closure means 30 is arranged along the full edge of one of the ends. It will also be appreciated that while the closure means 30 is shown in a three-piece configuration comprising center and flanking side portions 30*c*, 30*a*, and 30*b* respectively, it may as well be made in any number of additional side pieces to seal and close a larger exposure into the tank body 20. In this circumstance, the center portion 30*c* may or may not be positioned in the center of the closure but may as well be positioned toward one side edge or the other. In any case, the closure means 30 is not limited to a three-piece unit.

Finally, and because of the large sizes to which these tanks may be made, it may be advantageous to install web strap keepers 56 as shown in FIGS. 1, 2, and 9E. These may preferably be of the same rubberized square woven fabric and applied to the top plies 24 of the outer envelope structure 124 prior to vulcanization as shown in step 9E. Of course, a strip of release material is laid in along the axis of the keepers which is transverse to tank axis so as to form a tunnel passage therethrough upon completion of the vulcanization. Accordingly, when the tank 10 is filled and carried upon a tractor-trailer as shown in FIG. 1, the tie down straps 14 are inserted through the keepers 56 and therefore are maintained at the fore and aft positions of the tank during transport. This may be important when the tank is filled with a fluid material inasmuch as stopping and starting of the vehicle 12 tends to move the fluid in the opposite direction of motion. For example, when the vehicle is braked, the fluid tends to continue its forward momentum and because the tank body is a flexible structure this may loosen the tie down strap 14 at the aft position on the tank. Absence of a keeper 56 at this position may allow the tie down 14 to work its way off of the tank body completely. The same holds true of the forward strap position when the vehicle 12 accelerates. Thus, the keepers 56 may be provided to maintain the straps on the tank body 20 during the period of transport.

What is claimed is:

1. A flexible and collapsible storage tank for holding large volumes of material comprising in combination:

a substantially homogeneous rectangular tank body comprised of integrally vulcanized inner and outer envelope structures of rubberized square-woven fabric, the inner envelope structure formed by a plurality of long lengths of fabric having overlapping adjacent edges and oriented longitudinally while the outer envelope structure is formed by a plurality of edge plies of fabric folded about the peripheral edges of inner envelope structure and a plurality of lengths of fabric having overlapping adjacent edges and oriented orthogonally on either side of the inner envelope structure;

a vent valve mounted in the top of the tank body to communicate air into and out of the interior thereof when filling and emptying the tank body; and closure means mounted at one end and across a corner exposure of the tank body to seal the corner exposure and provide a connection for communication into the tank body.

2. The storage tank as set forth in claim 1 wherein the fabric comprises yarns which are oriented substantially in the longitudinal and transverse directions with respect to the lengthwise direction of the rectangular tank body.

3. The storage tank as set forth in claim 2 wherein the yarns are comprised of high tensile filaments selected from the group comprising nylon, polyester, and aramid.

4. The storage tank as set forth in claim 3 wherein the closure means comprises a center portion defining a bore into the tank body flanked by side portions, the center and side portions combining in their relationship to close and seal the corner exposure of the tank body.

5. The storage tank as set forth in claim 4 wherein the corner exposure is at an angle $\alpha$ of 45 degrees with respect to the longitudinal lengthwise direction of the tank body.

6. The storage tank as set forth in claim 4 wherein the center and side portions each comprise a top and bottom member bolted together to clamp rubberized fabric between them in a sealing relationship.

7. The storage tank as set forth in claim 6 wherein each top and bottom member has a flanged edge which is positioned toward the tank body to present a smooth transition surface to the rubberized fabric when the tank is filled.

8. The storage tank as set forth in claim 7 wherein strap keepers are integrally vulcanized at fore and aft positions on the top of the tank body.

* * * * *